US010267128B2

(12) United States Patent
Parrella

(10) Patent No.: US 10,267,128 B2
(45) Date of Patent: Apr. 23, 2019

(54) PULSING PRESSURE WAVES ENHANCING OIL AND GAS EXTRACTION IN A RESERVOIR

(71) Applicant: GTherm Energy, Inc., Westport, CT (US)

(72) Inventor: Michael J. Parrella, Weston, CT (US)

(73) Assignee: GTherm Energy, Inc., Wesport, CT (US)

( * ) Notice: Subject to any disclaimer, the term of this patent is extended or adjusted under 35 U.S.C. 154(b) by 0 days.

(21) Appl. No.: 15/517,586

(22) PCT Filed: Oct. 8, 2015

(86) PCT No.: PCT/US2015/054650

§ 371 (c)(1),
(2) Date: Apr. 7, 2017

(87) PCT Pub. No.: WO2016/057768

PCT Pub. Date: Apr. 14, 2016

(65) Prior Publication Data

US 2017/0241247 A1 Aug. 24, 2017

Related U.S. Application Data

(60) Provisional application No. 62/061,462, filed on Oct. 8, 2014, provisional application No. 62/061,448, filed on Oct. 8, 2014.

(30) Foreign Application Priority Data

May 19, 2015 (WO) ..... PCT/US2015/031486

(51) Int. Cl.
*E21B 43/25* (2006.01)
*E21B 43/24* (2006.01)
(Continued)

(52) U.S. Cl.
CPC ..... *E21B 43/24* (2013.01); *E21B 36/005* (2013.01); *E21B 36/04* (2013.01); *E21B 43/003* (2013.01); *E21B 43/164* (2013.01); *E21B 43/305* (2013.01)

(58) Field of Classification Search
CPC ..... E21B 43/003; E21B 43/25; E21B 28/00; E21B 43/12; E21B 43/128; E21B 44/005; E21B 47/06; E21B 43/124; E21B 43/24
See application file for complete search history.

(56) References Cited

U.S. PATENT DOCUMENTS 3,066,733 A 12/1962 Brandon
3,125,072 A 3/1964 Brandt et al.
(Continued)

FOREIGN PATENT DOCUMENTS

WO 01/59252 8/2001
WO 2013090901 6/2013

OTHER PUBLICATIONS

Russel, Daniel A., "Longitudinal and Transverse Wave Motion", https://www.acs.psu.edu/drussell/demos/waves/wavemotion.html, Aug. 26, 1998 (2 pages).
(Continued)

*Primary Examiner* — Zakiya W Bates
(74) *Attorney, Agent, or Firm* — Ware, Fressola, Maguire & Barber LLP

(57) ABSTRACT

A method and system are shown that conditions an underground reservoir to cause oil and gas to increase flow, excites the conditioned underground reservoir with pressure waves to further increase flow, and recovers the oil and gas with the increased flow. The excitation may be done via one or more production wells in synchronism with excitation done via one or more conditioning wells so as to cause constructive interference of the pressure waves and further increase flow.

27 Claims, 9 Drawing Sheets

(51) Int. Cl.

| | |
|---|---|
| ***E21B 43/16*** | (2006.01) |
| ***E21B 36/00*** | (2006.01) |
| ***E21B 36/04*** | (2006.01) |
| ***E21B 43/30*** | (2006.01) |
| ***E21B 43/00*** | (2006.01) |

(56) References Cited

U.S. PATENT DOCUMENTS

| | | | | |
|---|---|---|---|---|
| 3,132,692 | A | 5/1964 | Marx et al. | |
| 3,520,362 | A | 7/1970 | Galle | |
| 3,648,769 | A | 3/1972 | Sawyer | |
| 4,077,220 | A | 3/1978 | Matthews | |
| 4,078,608 | A | 3/1978 | Allen et al. | |
| 4,280,557 | A | 7/1981 | Bodine | |
| 4,319,632 | A | 3/1982 | Marr, Jr. | |
| 4,319,635 | A | 3/1982 | Jones | |
| 4,325,432 | A | 4/1982 | Henry | |
| 4,343,356 | A | 8/1982 | Riggs et al. | |
| 4,418,752 | A | 12/1983 | Boyer et al. | |
| 4,465,136 | A | 8/1984 | Troutman | |
| 4,538,682 | A | 9/1985 | McManus et al. | |
| 4,679,627 | A | 7/1987 | Harrison | |
| 4,824,447 | A | 4/1989 | Goldsberry | |
| 5,184,678 | A | 2/1993 | Pechkov et al. | |
| 5,695,643 | A | 12/1997 | Brandt et al. | |
| 6,012,521 | A | 1/2000 | Zunkel et al. | |
| 6,467,542 | B1 | 10/2002 | Kostrov et al. | |
| 6,536,523 | B1 | 3/2003 | Kresnyak | |
| 6,585,046 | B2 | 7/2003 | Neuroth et al. | |
| 6,788,619 | B2 | 9/2004 | Calvert | |
| 6,988,549 | B1 | 1/2006 | Babcock | |
| 7,743,826 | B2 | 6/2010 | Harris et al. | |
| 7,814,975 | B2 | 10/2010 | Hagen et al. | |
| 8,733,469 | B2 | 5/2014 | Konschuh et al. | |
| 8,746,333 | B2 | 6/2014 | Zolezzi-Garreton | |
| 8,770,313 | B2 | 7/2014 | Weddfelt et al. | |
| 8,851,169 | B2 | 10/2014 | Nikipelo | |
| 8,863,835 | B2 | 10/2014 | Schultz et al. | |
| 8,881,807 | B1 | 11/2014 | Orentlikherman et al. | |
| 2003/0047309 | A1 | 3/2003 | Thomas et al. | |
| 2009/0008088 | A1 | 1/2009 | Schultz et al. | |
| 2009/0056944 | A1 | 3/2009 | Nitschke | |
| 2009/0065197 | A1* | 3/2009 | Eslinger | E21B 43/003 166/249 |
| 2009/0090503 | A1* | 4/2009 | Groves | E21B 43/003 166/249 |
| 2009/0120633 | A1 | 5/2009 | Webb et al. | |
| 2010/0126395 | A1 | 5/2010 | Gauthier | |
| 2010/0170453 | A1 | 7/2010 | Betzer-Zilevitch | |
| 2014/0054032 | A1 | 2/2014 | Affholter et al. | |
| 2014/0083693 | A1 | 3/2014 | Frank | |
| 2014/0190691 | A1 | 7/2014 | Vinegar et al. | |
| 2014/0352947 | A1* | 12/2014 | Hallundæk | E21B 28/00 166/249 |
| 2015/0138924 | A1 | 5/2015 | Schaefers et al. | |

OTHER PUBLICATIONS

De La Croix, Robert F., "Elastic Wave Generator for Enhanced Oil Recovery", accessed Sep. 2014 (4 pages).
Beresnev, et al., "Elastic-wave stimulation of oil production: A review of methods and results", 59 Geophysics 1000-1017, Jun. 1994.
Alnoaimi, Kahlid Rashid, "Heavy Oil Recovery: Definitions and Means", http://large.stanford.edu/courses/2010/ph240/alnoaimi1/, Oct. 23, 2010 (6 pages).
Wikipedia.org, "Rock Mechanics", http://en.wikipedia.org/wiki/Rock_mechanics, Mar. 5, 2015 (2 pages).
Tunio, et al., "Comparison of Different Enhanced Oil Recovery Techniques for Better Oil Productivity", 5 Int'l Journal of Applied Science and Technology 143-153, Sep. 2011.
Russel, Daniel A., "Standing Sound Waves (Longitudinal Standing Waves)", https://www.acs.psu.edu/drussell/Demos/StandingWaves/StandingWaves.html, May 17, 2012 (2 pages).
Russel, Daniel A., "What is a Wave?",https://www.acs.psu.edu/drussell/Demos/waves-intro/waves-intro.html, Apr. 16, 2002 (1 page).
International Preliminary Report on Patentability, PCT/US15/31486, dated Oct. 14, 2016 (5 pages).
International Search Report and Written Opinion, PCT/US15/31486, dated Mar. 28, 2016 (8 pages).
International Search Report and Written Opinion, PCT/US15/54668, dated Jan. 21, 2016 (13 pages).
"Oversight Hearing on Spinning Straw Into Black Gold: Enhanced Oil Recovery Using Carbon Dioxide", U.S. House of Representatives Subcommittee on Energy and Mineral Resources Committee on Natural Resources, Jun. 12, 2008 (41 pages).
Laura Romero-Zeron, "Advances in Enhanced Oil Recovery Processes", www.intechopen.com, May 2012 (43 pages).
"The Global Taxonomy Initiative—The Response to a Problem", Secretariat of the Convention on Biological Diversity, Mar. 2015 (2 pages).
"Turbine", www.wikipedia.org/wiki/Turbine, Mar. 2015 (9 pages).
Per Johansson, et al., "Heavy Crude Oil as a Fuel for the SGT-500 Gas Turbine", VIII Forum Turbomaquinas Petrobras, Aug. 2011 (10 pages).
"Boiler (power generation)", www.wikipedia.org/wiki/Boiler_(power_generation), Mar. 2015 (10 pages).
"Boiler", www.wikipedia.org/wiki/Boiler, Mar. 2015 (10 pages).
"Gas flare", www.wikipedia.org/wiki/Gas_flare, Mar. 2015 (3 pages).
"Furnace", www.wikipedia.org/wiki/Furnace, Mar. 2015 (4 pages).
"Volumetric Heat Capacity", www.wikipedia.org/wiki/Volumetric_heat_capacity, Apr. 2015 (4 pages).
International Search Report and Written Opinion, PCT/US15/54646, dated Mar. 4, 2016 (13 pages).
E.R. Rangel-German, et al., Abstract of "Electrical-heating-assisted recovery for heavy oil." Journal of Petroleum Science and Engineering, vol. 45, Issues 3-4, Dec. 15, 2004, pp. 213-231, available at www.sciencedirect.com/article/pii/S0920410504000993 (2 pages).
Ahmad H. Haidari, et al., "Electrical Heating Methods for Oil Reservoir Stimulation", Mar. 11, 2013 (4 pages).
"Well Placement", www.niobraranews.net/well-placement, Jul. 2013 (8 pages).
Prats, Michael, Abstract for "Thermal Recovery", www.store.spe.org/Thermal-Recovery-P78.aspx, 1982 (2 pages).
"Porosity and Permeability", www.geomore.com/porosity-and-permeability-2, Feb. 2015 (3 pages).
Zusman, Neil, "Fracking: Gas Drilling and the Marcellus Shale", www.frack.mixplex.com/fracking, Aug. 24, 2010 (5 pages).
Gabe Bass, "Oil and Gas Basics: Drilling and Spacing Units." Bass Law, Jun. 4, 2012, 2 pages.
Albina Mukhametshina, et al., "Electromagnetic Heating of Heavy Oil and Bitumen: A Review of Experimental Studies and Field Applications." Journal of Petroleum Engineering, vol. 2013, Mar. 11, 2013, 7 pages.
"Thermal Recovery Methods for Heavy Oil Fields", www.mobilityoilandgas.com/thermal-recovery-methods-for-heavy-oil-fields, Apr. 2015 (5 pages).
Khalid Rashid Alnoaimi, "Heavy Oil Recovery: Definitions and Means", www.large.stanford.edu/courses/2010/ph240.alnoaimil, Stanford University, Oct. 23, 2010, 5 pages.
Roger M. Butler, "Thermal Recovery of Oil and Bitumen", Department of Chemical and Petroleum Engineering, University of Calgary, 1991, pp. i-xi, 30-47 and 72-85.
"Steam-assisted gravity drainage", www.wikipedia.org/wild/Steam-assisted_gravity_drainage, Nov. 2014 (8 pages).
"Pressure gradient", www.wikipedia.org/wiki/Pressure-gradient, Nov. 2014 (2 pages).
"Gradient", www.wikipedia.org/Gradient, Nov. 2014 (8 pages).
"Pressure-gradient force", www.wikipedia.org/Pressure-gradient-force, Nov. 2014 (2 pages).
USPTO Office Action in U.S. Appl. No. 15/517,616 dated Feb. 14, 2019.

* cited by examiner

PULSING PRESSURE WAVES ENHANCING OIL AND GAS EXTRACTION IN A RESERVOIR

CROSS-REFERENCE TO RELATED APPLICATIONS

The present application claims the benefit of U.S. Provisional Patent Application Ser. No. 62/061,462 filed Oct. 8, 2014, U.S. Provisional Patent Application Ser. No. 62/061,448 filed Oct. 8, 2014, and International Patent Application No. PCT/US15/31486, filed May 19, 2015 claiming the benefit of U.S. Provisional Patent Application Ser. No. 62/061,462 filed Oct. 8, 2014, each of which are hereby incorporated by reference in their entirety.

BACKGROUND OF THE INVENTION

In petroleum geology, a reservoir is a porous and permeable lithological unit or set of units that hold hydrocarbon reserves. Use of elastic or pressure waves in oil and gas reservoirs enhances recovery. Applied to a reservoir, wave excitation may increase the mobility of oil and gas trapped underground in porous material such as rock, for instance in the pores of oil reservoir rocks, or even in unconsolidated material. The objective is to remove barriers to flow into a well by improving the permeability of the porous material. A problem though is the dissipation of the wave energy as the wave traverses the reservoir. This is especially true for wave energy introduced to the reservoir from the surface. Another problem is the pressure waves have little effect on high viscosity oil deposits, such as heavy crude oil.

It is an objective of the present invention to address these shortcomings in the art.

SUMMARY OF THE INVENTION

According to a first aspect of the invention, a method for oil and gas recovery is provided, comprising conditioning an underground reservoir to cause oil and gas to increase flow, stimulating the conditioned underground reservoir with pressure waves to further increase flow, and recovering the oil and gas with increased flow.

According to an embodiment of the method of the first aspect of the invention, the stimulating is carried out with pressure waves from two or more locations in the underground reservoir so that pressure waves coming from a first location in the underground reservoir encounter pressure waves coming from at least a second location in the underground reservoir so as to combine through superposition in at least part of the underground reservoir. The pressure waves from the second location are in phase with the pressure waves from the first location in the at least part of the underground reservoir. The first locations include at least one injection well and the second location includes at least one production well. The injection well may comprise a pump to inject a fluid into the underground reservoir and the pump pulses the fluid injections to create the pressure waves. The oil production well may comprise at least one pump configured to pump oil, and the at least one pump is pulsed to create pressure waves.

According to a further embodiment of the method of the first aspect of the invention, the injection well may comprise a plurality of pipes, including a first pipe configured to inject hot, pressurized liquid water and a second pipe configured to inject colder liquid water in a pulsed manner. In such embodiment, the reservoir has a pressure lower than the hot, pressurized liquid and the hot, pressurized liquid turns to lower pressure water vapor after injection. The colder, liquid water mixes with the lower pressure water vapor, liquefying the water vapor. The changes in state and pressure of the hot, pressurized liquid create pulsing pressure waves.

According to a further embodiment of the method of the first aspect of the invention, the conditioning comprises thermal conditioning of the underground reservoir. The thermal conditioning comprises heated brine/water flooding of the underground reservoir. The thermal conditioning may further comprises combining $CO_2$ exhaust with heated brine/water used in the heated brine/water flooding, wherein the $CO_2$ is exhaust from a boiler fueled by the recovered gas to heat the brine/water recovered with the oil and gas before flooding the underground reservoir with the brine/water heated by the boiler.

In a further embodiment, the thermal conditioning can also comprise circulating a heated fluid in a closed circulation system having part of the closed circulation system in the underground reservoir. The thermal conditioning may further comprises pumping heated brine into a brine injection well in the underground reservoir using brine recovered along with the oil and gas from the underground reservoir, the recovered brine is separated and heated in a heat exchanger by the heated fluid circulating in the closed circulation system, the heat exchanger is fed by a boiler fueled by gas recovered from the underground reservoir, and the recovered brine mixed with $CO_2$ exhausted from the boiler. The pressure waves are caused by a disturbance introduced into the heated brine that is pumped into the injection well.

According to a further embodiment of the method of the first aspect of the invention, the method further comprises circulating fluid both inside and outside the underground reservoir in a closed circulation system with a system part located at least in part in the underground reservoir and with a system part located at least in part outside the underground reservoir, and heating a cooled part of the fluid that is circulating in the system part located at least in part outside the underground reservoir after circulating out of the system part located at least in part in the underground reservoir so that the cooled part becomes a heated part of the circulating fluid, wherein the conditioning includes at least part of the heated part of the circulating fluid transferring heat to the underground reservoir when the at least part of the heated part of the circulating fluid is circulating in the system part located at least in part in the underground reservoir. The heating can be carried out at least in part by a boiler and the boiler is fueled by gas extracted from the underground reservoir. The method may further comprise heating brine extracted from the underground reservoir by exchanging heat with at least another part of the heated part of the circulating fluid, mixing the brine extracted from the underground reservoir with $CO_2$ exhausted from the boiler, wherein the conditioning includes flooding the underground reservoir with the heated brine mixed with $CO_2$ exhausted from the boiler. At least part of the heating of the circulating fluid can be carried out by heating the circulating fluid with heat from a geothermal well. Part of the closed circulation system is in the geothermal well and at least part of the heating of the circulating fluid is carried out by a boiler fueled by gas extracted from the underground reservoir. This embodiment of the method may further comprise heating brine extracted from the underground reservoir when the fluid in the closed circulation system circulates out of the system part located at least in part in the underground reservoir and when the fluid is circulating in the system part located at least in part outside the underground reservoir, mixing the brine extracted from the underground reservoir with $CO_2$ exhausted from the boiler, and wherein the conditioning includes flooding the underground reservoir with the heated brine mixed with $CO_2$ exhausted from the boiler. Pressure waves can be caused by a disturbance introduced into the heated brine mixed with $CO_2$ that is pumped into the injection well to flood the underground reservoir and synchronized with another disturbance applied to a mixture of brine, oil, and gas undergoing recovery in a part of an oil production well located at least in part in the underground reservoir so that pressure waves coming from the heated brine mixed with $CO_2$ add constructively in the underground reservoir with pressure waves coming from the mixture of brine, oil, and gas in the production well. The underground reservoir can be pulsed with pressure waves propagated into the underground reservoir from pulsing the heated brine mixed with $CO_2$ during injection in synchronism with pressure waves propagated into the underground reservoir from pulsing the oil, gas, and brine in the underground reservoir, during extraction.

According to a second aspect of the invention, an apparatus for oil and gas recovery is provided. The apparatus comprises one or more pumps for extracting oil, gas, and brine from production wells in an underground reservoir, at least one separator for separating the oil, gas, and brine, a boiler fueled by the separated gas for heating a fluid in the closed circulation system, a heat exchanger for receiving the fluid heated by the boiler in the closed circulation system for facilitating an exchange of heat from the fluid heated by the boiler to the separated brine so as to provide heated brine, a mixer for mixing $CO_2$ exhausted from the boiler with the heated brine, and an injection pump for injecting the heated brine mixed with $CO_2$ into the underground reservoir, wherein the oil is recovered from the separator with increased flow.

According to a third aspect of the invention, an apparatus for oil and gas recovery is provided. The apparatus comprises means for conditioning an underground reservoir to cause oil and gas to increase flow, means for pulsing the conditioned underground reservoir with pressure waves to further increase flow, and means for recovering the oil and gas with increased flow.

According further to the third aspect of the invention, the means for conditioning may comprise one or more of means for thermal flooding, means for brine/water flooding, and for $CO_2$ flooding.

According to a further embodiment of the third aspect of the invention, the means for conditioning can further comprise means for thermal flooding with heated fluid circulating in a closed circulation system having part of the closed circulation system in the underground reservoir, and means for thermal flooding with heated brine/$CO_2$ pumped into a hot brine well in the underground reservoir using brine recovered along with the oil and gas from the underground reservoir, the recovered brine separated and heated in a heat exchanger by the heated fluid circulating in the closed circulation system, the heat exchanger fed by a boiler fueled by gas recovered from the underground reservoir, the recovered brine mixed with $CO_2$ exhausted from the boiler. The pulsing according to this embodiment can comprises means for pulsing the hot brine well and the heated brine/$CO_2$ therein with pressure waves at a controlled frequency and synchronized with pressure waves pulsing in a brine, oil, and gas mixture in a part of a production well in the underground reservoir.

DETAILED DESCRIPTION OF THE FIGURES

The present invention will now be described in further detail, with reference made to FIGS. 1-9.

Figure 1C:
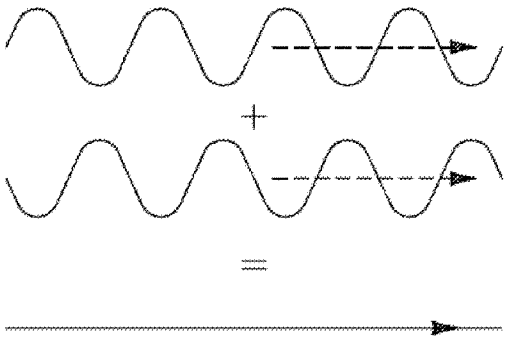
FIG. 1*c* shows destructive interference caused when waves meet out-of-phase.
Figure 1D:
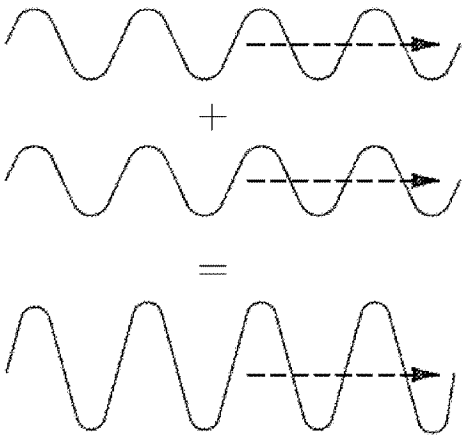
FIG. 1*d* shows constructive interference caused when waves meet in-phase.
Figure 1A:
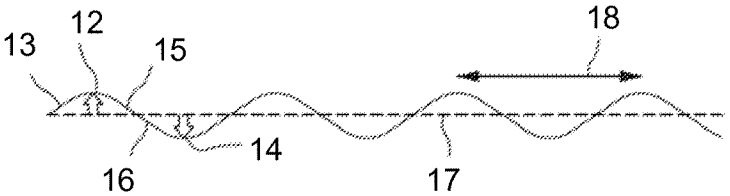
FIG. 1*a* shows a longitudinal sound wave propagating in air and having a sinusoidal form with pressure peaks and troughs shown in relation to atmospheric pressure.
Figure 1B:
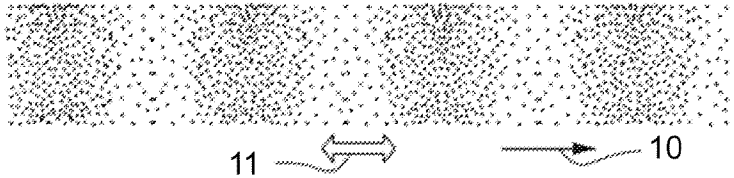
FIG. 1*b* is in alignment with FIG. 1*a* to show the wave of FIG. 1*a* causing air particle displacement parallel to the direction of propagation, left to right in the Figure, with rarefactions and compressions of air molecules corresponding to the decreased pressure and increased pressure, respectively, as compared to atmospheric pressure in FIG. 1*a*.

FIGS. 1*a* and 1*b* show an example of a longitudinal sound wave produced in air, for example, by a vibrating tuning fork. A wave is a disturbance or variation that travels through a medium. The medium in the example of FIGS. 1*a* and 1*b* is air through which the disturbance or sound or pressure wave travels. The pressure of a sinusoidal pressure wave is shown plotted versus time in FIG. 1*a* propagating 10 from left to right. If FIGS. 1*a* and 1*b* were animated, the impression would be that the regions of compression travel from left to right. In reality, although the air molecules experience some local oscillations as the pressure wave passes, the molecules do not travel with the wave. As the tines of the fork vibrate back and forth, they push on neighboring air molecules. The forward motion of a tine pushes air molecules horizontally to the right to create a high-pressure area and the backward retraction of the tine to the left creates a low-pressure area allowing the air molecules to move back to the left. As shown in the plot of displacement in the bottom half in FIG. 1*b*, because of the longitudinal motion 11 of the air molecules, there are regions where the air molecules are compressed together and other regions where the air molecules are spread apart. These regions are known as compressions and rarefactions, respectively. The compressions are regions of high air pressure and the rarefactions are regions of low air pressure. At the far left of FIG. 1*b*, an increased pressure compression is depicted corresponding to a peak 12 in FIG. 1*a*, following an up amplitude 13. A decreased pressure rarefaction corresponding to a trough 14 then follows down amplitudes 15 and 16. The maximum distance (the crest or trough) that a molecule of the air moves away from its rest position, indicated by horizontal line 17 in FIG. 1*a*, is the amplitude. As such, this may be understood as the amplitude of the movement of an air molecule caused by the pressure wave as it propagates through the air. The sinusoid in FIG. 1*a* represents the extremes of the horizontal molecule displacement amplitude of the air molecules as the pressure wave moves. It may also be seen as representative of the pressure amplitude of the wave as it propagates through the air. The wavelength 18 of such a wave is the distance that the wave travels in the air in one complete wave cycle. The wavelength is commonly measured as the distance from one compression to the next adjacent compression or the distance from one rarefaction to the next adjacent rarefaction.

In accordance with the present invention, excitation of an oil reservoir with a pressure wave results in a repeating pattern of high-pressure and low-pressure regions moving through the oil reservoir, which enhances oil recovery by causing movement in the walls of a pore 75 of a particle of rock 70, so as to induce movement and flow of oil 30, gas 40 and water 20 out of the pore 75. It also breaks the surface tension 60 of the capillaries 50 in the rock pore 75. To cause pressure waves characterized by cycles of low and high pressure, pumps or other forms of transducers may be used, as will be described further herein. The length of one cycle (i.e., the wavelength) and the number of times the cycle repeats itself per unit time defines the frequency of the pressure wave. The velocity of the wave depends on the medium but is defined as the frequency times the wavelength.

Wave interference is the phenomenon that occurs when two waves meet while traveling along the same medium. The interference of waves causes the medium to take on a shape that results from the net effect of the two individual waves upon the particles of the medium. Consider two pulses of the same amplitude traveling in different directions along the same medium. Each pulse is displaced upward one unit at its crest and has the shape of a sine wave. As the sine waves move towards each other, there will eventually be a moment in time when the waves completely overlap. At that moment, the resulting shape of the medium would be an upward displaced sine pulse with amplitude of two units. This is constructive interference as shown in FIG. 1*d*. On the other hand, FIG. 1*c* depicts the results when two equal waves meet that are 180° out of phase. When the two out of phase waves meet, the compression and rarefactions overlay and the resultant wave has zero compression and rarefaction, as the waves cancel each other with destructive interference. If two waves meet in-phase, the compression is additive and the rarefaction is additive, as in FIG. 1*d*.

According to the teachings of the present invention, constructive wave interference, such as shown in FIG. 1*d*, can be used to enhance oil and gas recovery by increasing the flow of oil and gas in a reservoir. Such may be done with conditioning of the reservoir before or at the same time as the wave pulsing to further enhance oil and gas recovery, or it may be done without conditioning of the reservoir. In other words, although examples described or shown below may show constructive wave interference used in conjunction with conditioning to enhance flow, it should be understood that constructive wave interference may be used as a standalone technique, by itself, for the same purpose. The constructive interference may be of modulated pressure waves that modulate at a lower frequency than an underlying pressure wave at a higher frequency.

Figure 2:
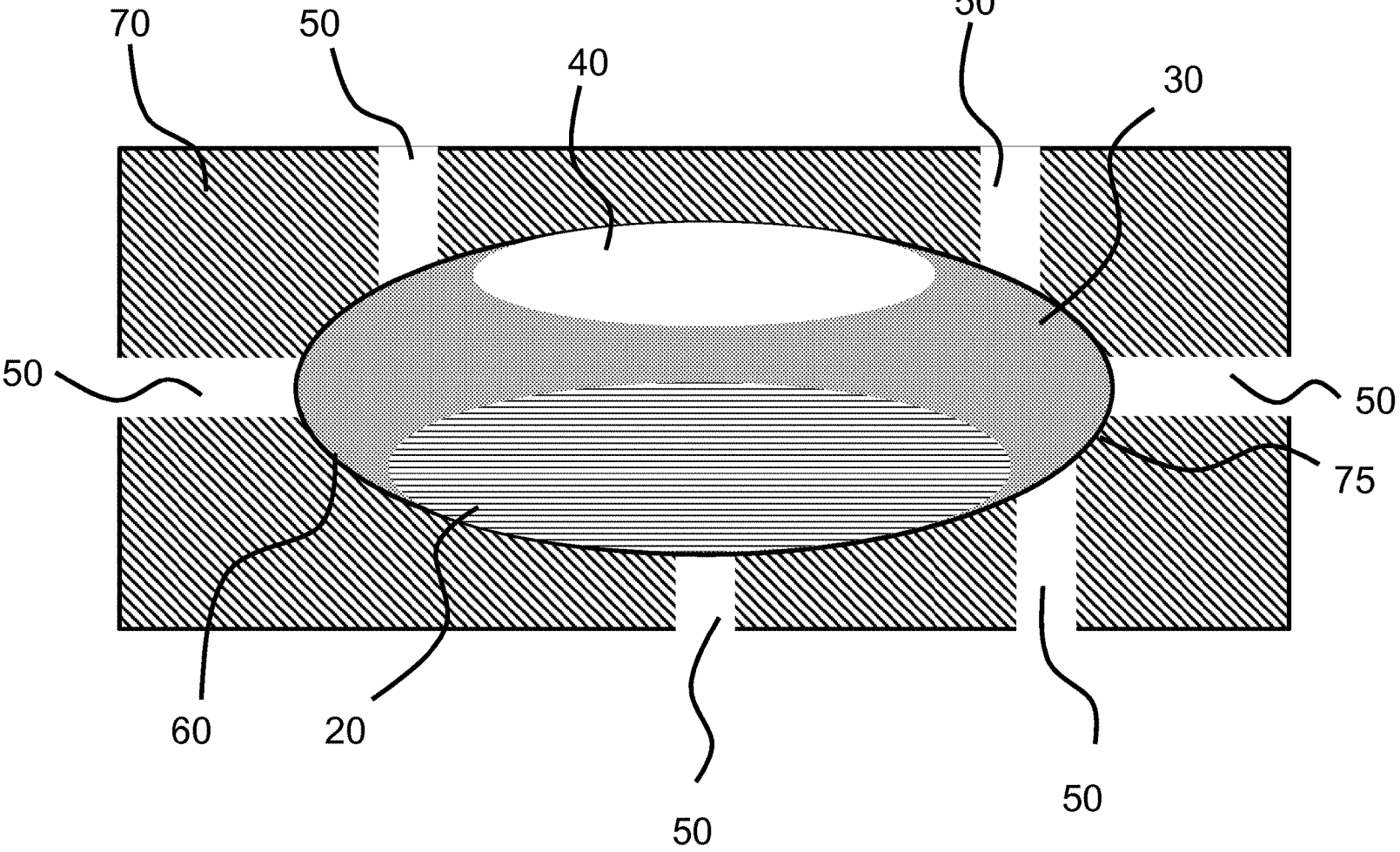
FIG. 2 shows a rock pore that is filled with gas, oil and water.

At a microscopic level a reservoir may contain hydrocarbon reserves as shown in FIG. 2. Water 20, oil 30, and gas 40 are contained in rock pores 75 in a particle of rock 70. The proportion of each fluid is determined by the characteristics of the reservoir. Surface tension 60 constrains the fluids from flowing through capillaries 50 in the particle of rock 70. At a macroscopic level, the reservoir may comprise an assemblage of a large number of such rock particles 70 containing water 20, oil 30 and/or gas 40.

When the reservoir is disturbed or displaced by imparting energy by way of stimulation, for instance by wave excitation, the displacement will give rise to an elastic force in the material adjacent to it, then the next particle of water 20, oil 30, or gas 40 will be displaced, and then the next, and so on. The displacement will be propagated with a speed dependent on the physical properties of the reservoir. If the excitation is oscillatory, an oscillatory pressure wave is the result, i.e., a wave that results from the back and forth vibration of particles of the medium through which the wave is moving. If a wave is moving from left to right through a medium, then particles of the medium will be displaced both rightward and leftward as the energy of the wave passes through it. The motion of the particles is parallel to the direction of the energy transport. This is what characterizes waves as longitudinal waves.

Figure 3:
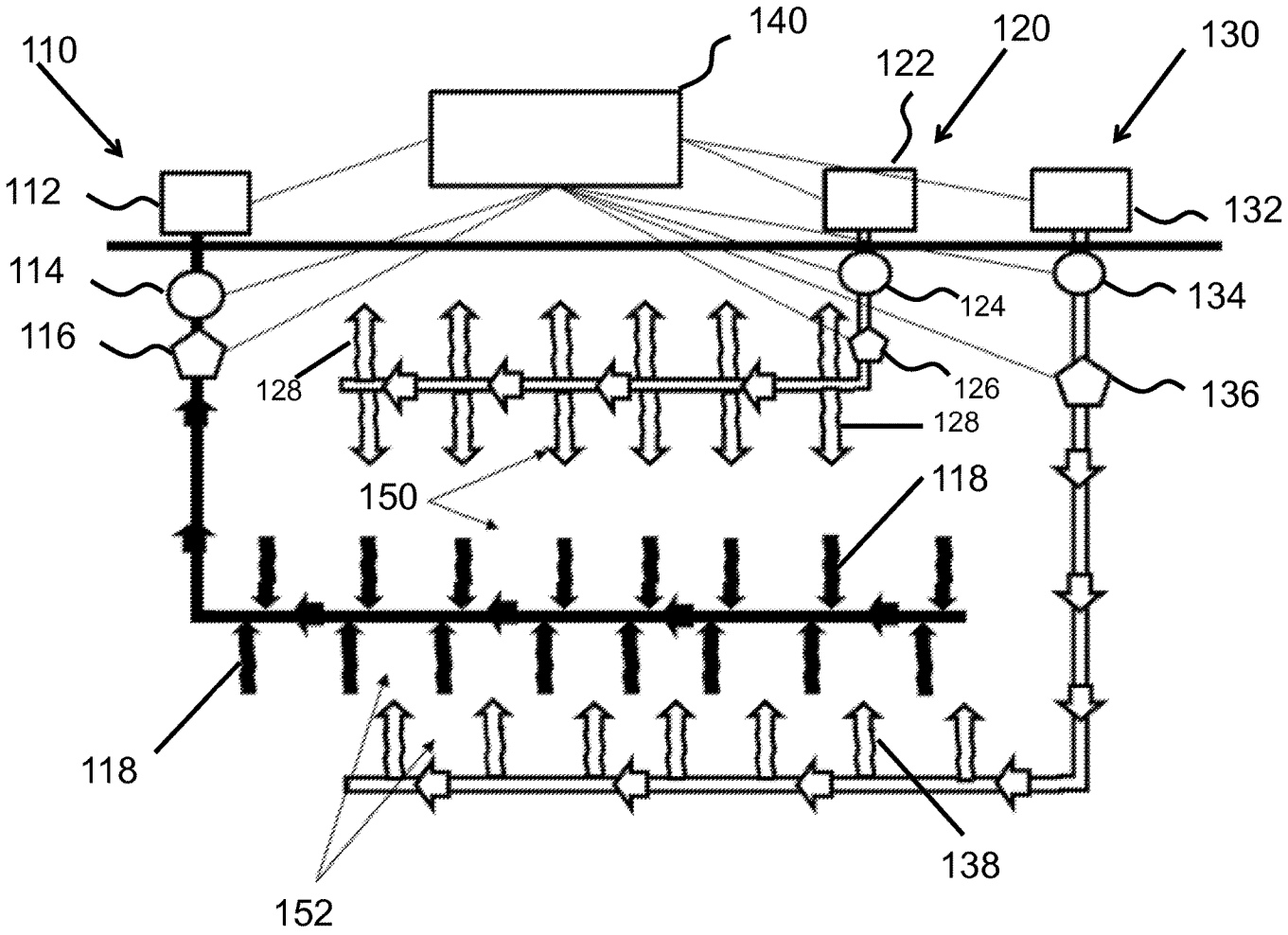
FIG. 3 shows a control system and the generation of pulsing pressure waves according to an embodiment of the invention
Figure 4:
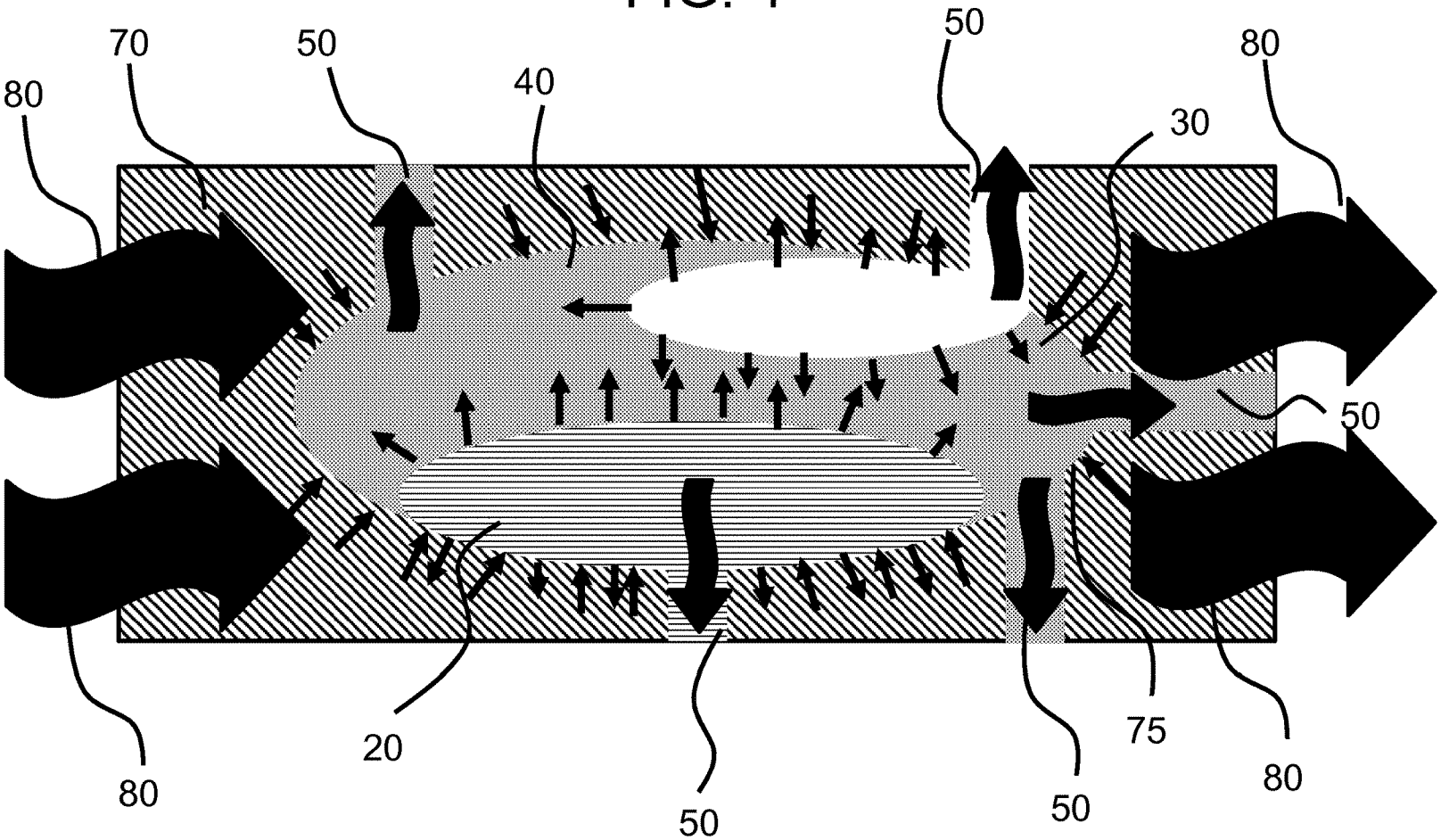
FIG. 4 shows a rock pore and the additional impact of pulsing from the injection wells and production wells on the oil and gas mobility according to an embodiment of the invention.

A system and methodology for stimulating a reservoir with pressure waves is shown in FIGS. 3 and 4. Such may for example be done by pulsing an underground reservoir with pressure waves to further increase flow and thereby enable the recovery of even more oil and gas. For instance, acoustic waves may be longitudinal waves that propagate by means of adiabatic compression and decompression in the reservoir. As described above, longitudinal waves have the same direction of vibration as their direction of propagation. Acoustic waves propagate with the speed of sound which depends on the medium. Acoustic waves are characterized by sound pressure, particle velocity, particle displacement, and sound intensity.

Figure 7:
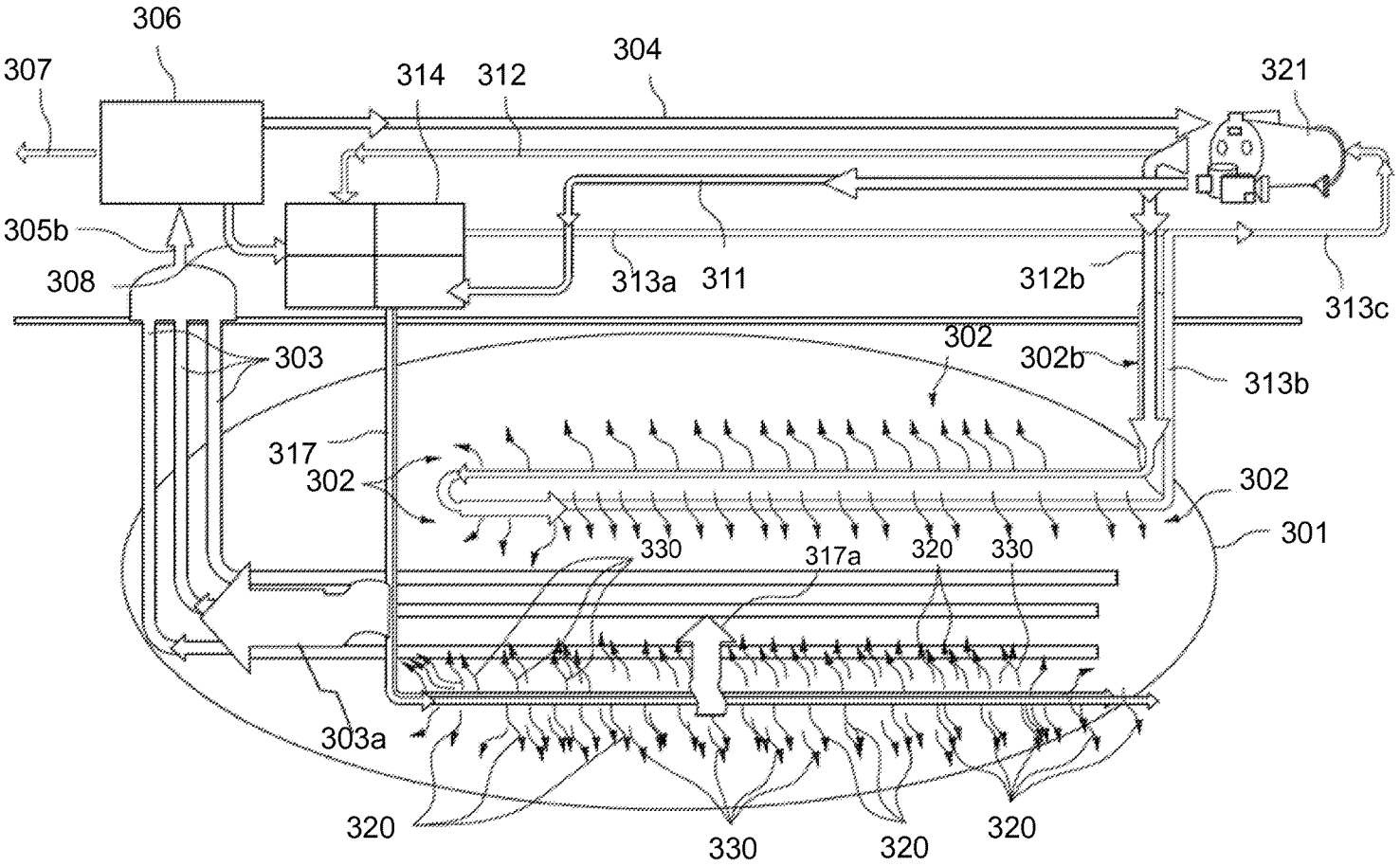
FIG. 7 shows an embodiment of oil and gas extraction in a conditioned reservoir applying pulsing pressure waves according to an embodiment of the invention.

FIG. 3 shows a pressure wave system according to an embodiment of the invention that includes pressure wave valves/transducers 114, 124, 134, applied to hot brine and $CO_2$ injection wells 120, 130 and oil production wells 110. A pressure wave control system 140 senses a parameter such as pressure (e.g. sound pressure) by means of pressure sensors 116, 126, 136 and controls the pumps 112, 122, 132 and the valves 114, 124, 134 and transducers associated with the oil production well 110 and the injection wells 120, 130. The pressure waves 118 through brine/oil/gas in the production well 110 are controlled by the control system 140 to add constructively 150, 152 with the pressure waves 128, 138 through brine/$CO_2$ in the injection wells 120, 130. This in-phase synchronization of the pulsing pressure waves 118, 128, 138 applied to the two different types of fluid mixtures results in resonant pulsing waves, such as waves 303*a* such as shown in FIG. 7. The synchronized pulsing pressure waves 303*a* act even more effectively on a reservoir 301 conditioned in the manner shown and described below in connection with FIGS. 7-9 to further reduce surface tension, reduce capillary resistance, and move pore walls to thereby induce oil 30 trapped in pores 75 to become untrapped and combine with other untrapped oil so as to increase the oil flow volume. This is illustrated in FIG. 4 which shows pulsing waves 80 coaxing oil 30 from low permeable to high permeable areas by breaking the surface tension 60 and enhancing flow through capillaries 50.

The control system 140 of FIG. 3 controls the frequency and amplitude of pressure waves 118, 128, 138 injected into the reservoir by the oil production well 110 and the injection wells 120, 130. The control system 140 measures the resultant pressure waves 118, 128, 138 with the pressure sensors 116, 126, 136. By managing the pressure waves 118, 128, 138, the control system 140 can create constructive reenforcement 150, 152 of the pressure waves 118, 128, 138 in the reservoir to maximize their effectiveness in enhancing oil and gas flow and recovery.

In an exemplary operation of the present invention, the oil production well 110 is pulsed, creating the first pressure wave 118 in the reservoir. The pressure wave 118 generated by the production well 110 has the effect of pulling oil, gas and/or brine towards the oil production well 110 through ports in the production well 110, where the oil is then pumped to the surface. The pressure pulse 118 can be generated by pulsing the pump 112 or by opening and restricting the flow through the valve 114 to the production well 110 using a valve 114. The amplitude of the pressure wave 118 is determined by the amount the pump 112 power is varied or the amount the flow is restricted through the valve 114 by partially closing the valve 114. The frequency of the pressure wave 118 is controlled by timing the pulsing of the pump 112 or the timing of opening and partially closing the valve 114.

Another way of generating the pressure wave 118 is by adding a transducer that will provide additional timed pressure pulses to the flow. A starting low frequency for the generated pressure wave 118 is determined by the make-up of the geology of the reservoir. Once a starting frequency is selected, the frequency can be increased and/or decreased by the control system 140 until the maximum oil and gas flow is achieved. More than one frequency can be used over the course of generating the pressure waves 118.

Further, one or more injection wells 120, 130 are pulsed creating pressure waves 128, 138 in the reservoir. The pressure waves 128, 138 generated by the injection wells 120, 130 from brine and $CO_2$ passing through ports in the injection wells 120, 130 have the effect of pushing oil towards the oil production well 110, where the oil is then pumped to the surface. The pressure waves 128, 138 can be generated by pulsing the pump 122, 132, or by opening and restricting the flow through the valves 124, 134 through the injection wells 120, 130 using the valve 124, 134. The amplitude of the pressure waves 128, 138 is determined by the amount the pump 122, 132 power is varied or the amount the flow is restricted through the valves 124, 134 by repeatedly partially closing and opening the valves 124, 134. The frequency of the pressure waves 128, 138 is controlled by timing the pulsing of the pump 122, 132 or the timing of opening and partially closing the valves 124, 134. Another manner of generating the pressure waves 128, 138 is by adding a transducer that will add additional timed pressure pulses to the flow. The frequency (or frequencies if more than one frequency is used) of the waves 128, 138 should match the frequency of the pulsing waves 118 of the oil and gas production well 110. The timing of the creation of the pressure wave 128, 138 is timed by the control system 140 so that constructive wave interference 150, 152 is achieved to create a heightened pressure wave 80. The constructive wave interference 150, 152 increases the amplitude and distance the pressure wave 80 may penetrate and influence flow in the reservoir, which increase the pushing and pulling effects of the waves in the reservoir.

The control system 140 constantly monitors the pressure wave system and adjusts the frequencies and amplitudes of the pressure waves 118, 128, 138 in order to maximize oil 30 and gas 40 flow out of the rock pores 70, and hence maximize the volume of oil 30 and gas 40 extracted per unit time. Because the pressure waves 118, 128, 138 will travel through different media of the reservoir at different speeds, the control system 140 is configured to adjust the timing of the pressure waves to ensure the maximum effect on the oil and gas extraction. The speeds of pulsing waves through various media are indicated below in Tables 1, 2 and 3.

TABLE 1

(Solids)

| Substance | Density ($g/cm^3$) | Vl (m/s) | Vs (m/s) | Vext (m/s) |
|---|---|---|---|---|
| Metals | | | | |
| Aluminum, rolled | 2.7 | 6420 | 3040 | 5000 |
| Beryllium | 1.87 | 12890 | 8880 | 12870 |
| Brass (70 Cu, 30 Zn) | 8.6 | 4700 | 2110 | 3480 |
| Copper, annealed | 8.93 | 4760 | 2325 | 3810 |
| Copper, rolled | 8.93 | 5010 | 2270 | 3750 |
| Gold, hard-drawn | 19.7 | 3240 | 1200 | 2030 |
| Iron, Armco | 7.85 | 5960 | 3240 | 5200 |
| Lead, annealed | 11.4 | 2160 | 700 | 1190 |
| Lead, rolled | 11.4 | 1960 | 690 | 1210 |
| Molybdenum | 10.1 | 6250 | 3350 | 5400 |
| Monel metal | 8.9 | 5350 | 2720 | 4400 |
| Nickel (unmagnetized) | 8.85 | 5480 | 2990 | 4800 |
| Nickel | 8.9 | 6040 | 3000 | 4900 |
| Platinum | 21.4 | 3260 | 1730 | 2800 |
| Silver | 10.4 | 3650 | 1610 | 2680 |
| Steel, mild | 7.85 | 5960 | 3235 | 5200 |
| Steel, 347 Stainless | 7.9 | 5790 | 3100 | 5000 |
| Tin, rolled | 7.3 | 3320 | 1670 | 2730 |
| Titanium | 4.5 | 6070 | 3125 | 5080 |
| Tungsten, annealed | 19.3 | 5220 | 2890 | 4620 |
| Tungsten Carbide | 13.8 | 6655 | 3980 | 6220 |
| Zinc, rolled | 7.1 | 4210 | 2440 | 3850 |
| Various | | | | |
| Fused silica | 2.2 | 5968 | 3764 | 5760 |
| Glass, Pyrex | 2.32 | 5640 | 3280 | 5170 |
| Glass, heavy silicate flint | 3.88 | 3980 | 2380 | 3720 |
| Lucite | 1.18 | 2680 | 1100 | 1840 |
| Nylon 6-6 | 1.11 | 2620 | 1070 | 1800 |
| Polyethylene | 0.9 | 1950 | 540 | 920 |
| Polystyrene | 1.06 | 2350 | 1120 | 2240 |
| Rubber, butyl | 1.07 | 1830 | | |
| Rubber, gum | 0.95 | 1550 | | |
| Rubber neoprene | 1.33 | 1600 | | |
| Brick | 1.8 | | | 3650 |
| Clay rock | 2.2 | | | 3480 |
| Cork | 0.25 | | | 500 |
| Marble | 2.6 | | | 3810 |
| Paraffin | 0.9 | | | 1300 |
| Tallow | | | | 390 |
| Ash, along the fiber | | | | 4670 |
| Beech, along the fiber | | | | 3340 |
| Elm, along the fiber | | | | 4120 |
| Maple, along the | | | | 4110 |

TABLE 2

(Liquids)

| Substance | Formula | Density ($g/cm^3$) | Velocity at 25° C. (m/s) | $-\delta v/\delta t$ (m/sec ° C.) |
|---|---|---|---|---|
| Acetone | $C_3H_6O$ | 0.79 | 1174 | 4.5 |
| Benzene | $C_6H_6$ | 0.87 | 1295 | 4.65 |
| Carbon | $CCl_4$ | 1.595 | 926 | 2.7 |
| Castor oil | $C_{11}H_{10}O_{10}$ | 0.969 | 1477 | 3.6 |
| Chloroform | $CHCl_3$ | 1.49 | 987 | 3.4 |

TABLE 2-continued (Liquids)

| Substance | Formula | Density ($g/cm^3$) | Velocity at 25° C. (m/s) | $-\delta v/\delta t$ (m/sec ° C.) |
|---|---|---|---|---|
| Ethanol amide | $C_2H_7NO$ | 1.018 | 1724 | 3.4 |
| Ethyl ether | $C_4H_{10}O$ | 0.713 | 985 | 4.87 |
| Ethylene glycol | $C_2H_6O_2$ | 1.113 | 1658 | 2.1 |
| Glycerol | $C_3H_8O_3$ | 1.26 | 1904 | 2.2 |
| Kerosene | | 0.81 | 1324 | 3.6 |
| Mercury | Hg | 13.5 | 1450 | |
| Methanol | $CH_4O$ | 0.791 | 1103 | 3.2 |
| Turpentine | | 0.88 | 1255 | |
| Water (distilled) | $H_2O$ | 0.998 | 1496.7 | −2.4 |

TABLE 3

(Gases)

| Substance | Formula | Density (g/L) | Velocity (m/s) | $\delta v/\delta t$ (m/sec ° C.) |
|---|---|---|---|---|
| Air, dry | | 1.293 | 331.45 | 0.59 |
| Ammonia | $NH_3$ | 0.771 | 415 | |
| Argon | Ar | 1.783 | 319 (at 20° C.) | 0.56 |
| Carbon monoxide | CO | 1.25 | 338 | 0.6 |
| Carbon dioxide | $CO_2$ | 1.977 | 259 | 0.4 |
| Chlorine | $Cl_2$ | 3.214 | 206 | |
| Deuterium | $D_2$ | | 890 | 1.6 |
| Ethane (10° C.) | $C_2H_6$ | 1.356 | 308 | |
| Ethylene | $C_2H_4$ | 1.26 | 317 | |
| Helium | He | 0.178 | 965 | 0.8 |
| Hydrogen | $H_2$ | 0.0899 | 1284 | 2.2 |
| Hydrogen chloride | HCl | 1.639 | 296 | |
| Methane | $CH_4$ | 0.7168 | 430 | |
| Neon | Ne | 0.9 | 435 | 0.8 |
| Nitric oxide (10° C.) | NO | 1.34 | 324 | |
| Nitrogen | $N_2$ | 1.251 | 334 | 0.6 |
| Nitrous oxide | $N_2O$ | 1.977 | 263 | 0.5 |
| Oxygen | $O_2$ | 1.429 | 316 | 0.56 |
| Sulfur dioxide | $SO_2$ | 2.927 | 213 | 0.47 |
| | | Vapors | | |
| Acetone | $C_3H_6O$ | | 239 | 0.32 |
| Benzene | $C_6H_6$ | | 202 | 0.3 |
| Carbon tetrachloride | $CCl_4$ | | 145 | |
| Chloroform | $CHCl_3$ | | 171 | 0.24 |
| Ethanol | $C_2H_6O$ | | 269 | 0.4 |
| Ethyl ether | $C_4H_{10}O$ | | 206 | 0.3 |
| Methanol | $CH_4O$ | | 335 | 0.46 |
| Water vapor | $H_2O$ | | 494 | 0.46 |

Figure 5B:
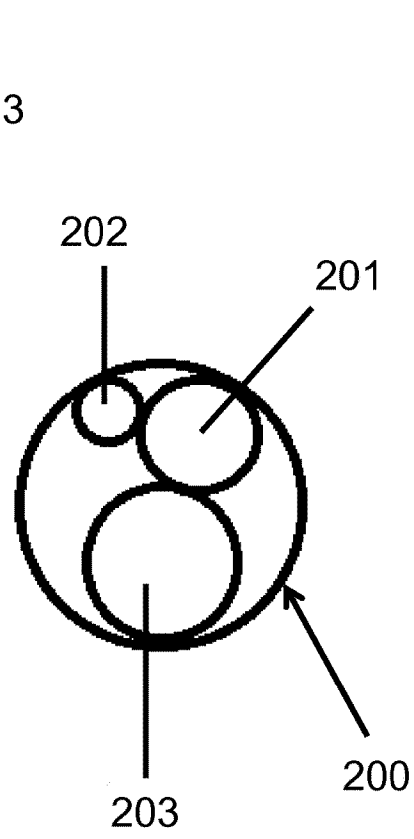
FIGS. 5*a* and 5*b* show a system design for thermally-induced, steam-collapse, shock pulse generation, according to an embodiment of the invention.
Figure 5A:
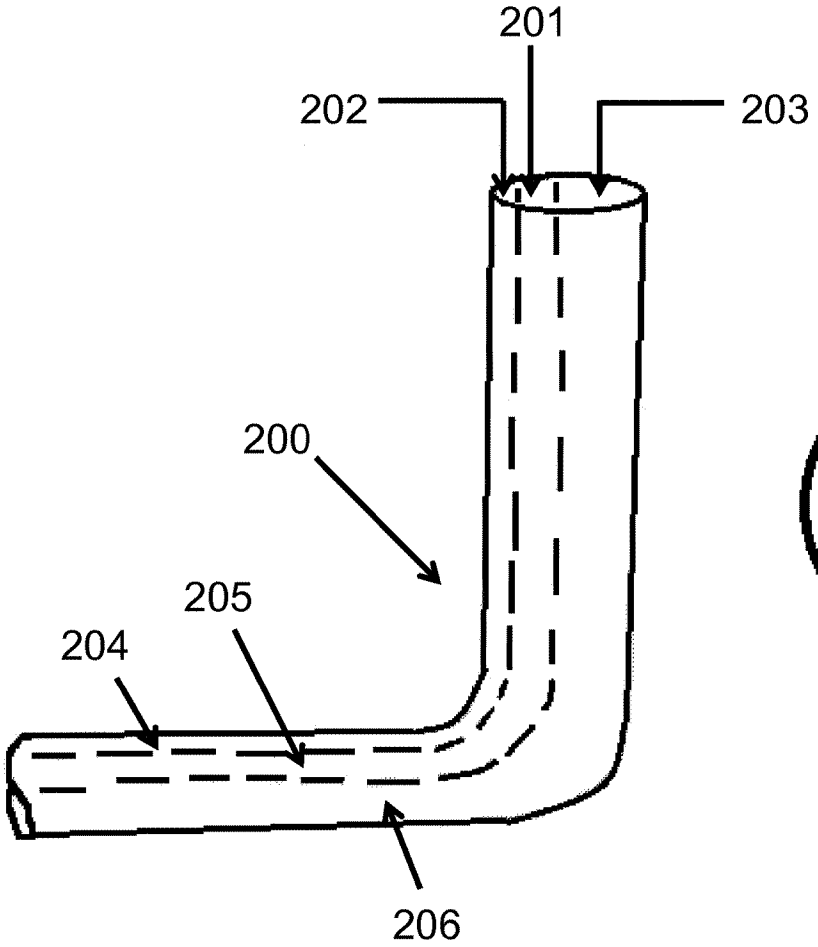

A further method for generating pressure pulses in accordance with the invention is shown in FIGS. 5*a* and 5*b*. Within a porous pipe 200, a plurality of tubes or pipes 201, 202, 203, each having ports, are provided. A water tube 201 is provided with a pulsed supply of heated liquid water that flows through the tube 201. The heated liquid water is pressurized so that the water can maintain its liquid form at a high temperature while travelling through the tube 201. As the liquid water exits the tube through an outlet 204 in the reservoir, which has a lower pressure, and the water experiences a decrease in pressure, which causes the water to vaporize.

A second, insulated water tube 202 is provided with a supply of cooler water that flows through the tube 202. The water supplied through the tube 202 is supplied in a timed, pulsed manner. As a result, water escapes through the perforations of the tube outlet 205 and mixes with the previously described vaporized water created from the drop in pressure of the water from tube 201 in spurts. The temperature of the resulting combined flow is lower and the causes the vaporized water to reliquify and with a significant pressure decrease.

The rapid change of the water from a liquid form to a vapor form and back to a liquid form causes large pressure jumps and rapid depressurization. This creates a substantial pressure pulsing wave for pushing oil and gas in a reservoir to an oil production well.

The pipe 200 of FIGS. 5*a* and 5*b* can be used as an injection well 120, 130, for example. This method can be also used in conjunction with the pulsing methods described previously to increase the amplitude of the pulses in the primary water tube 201.

Figure 6:
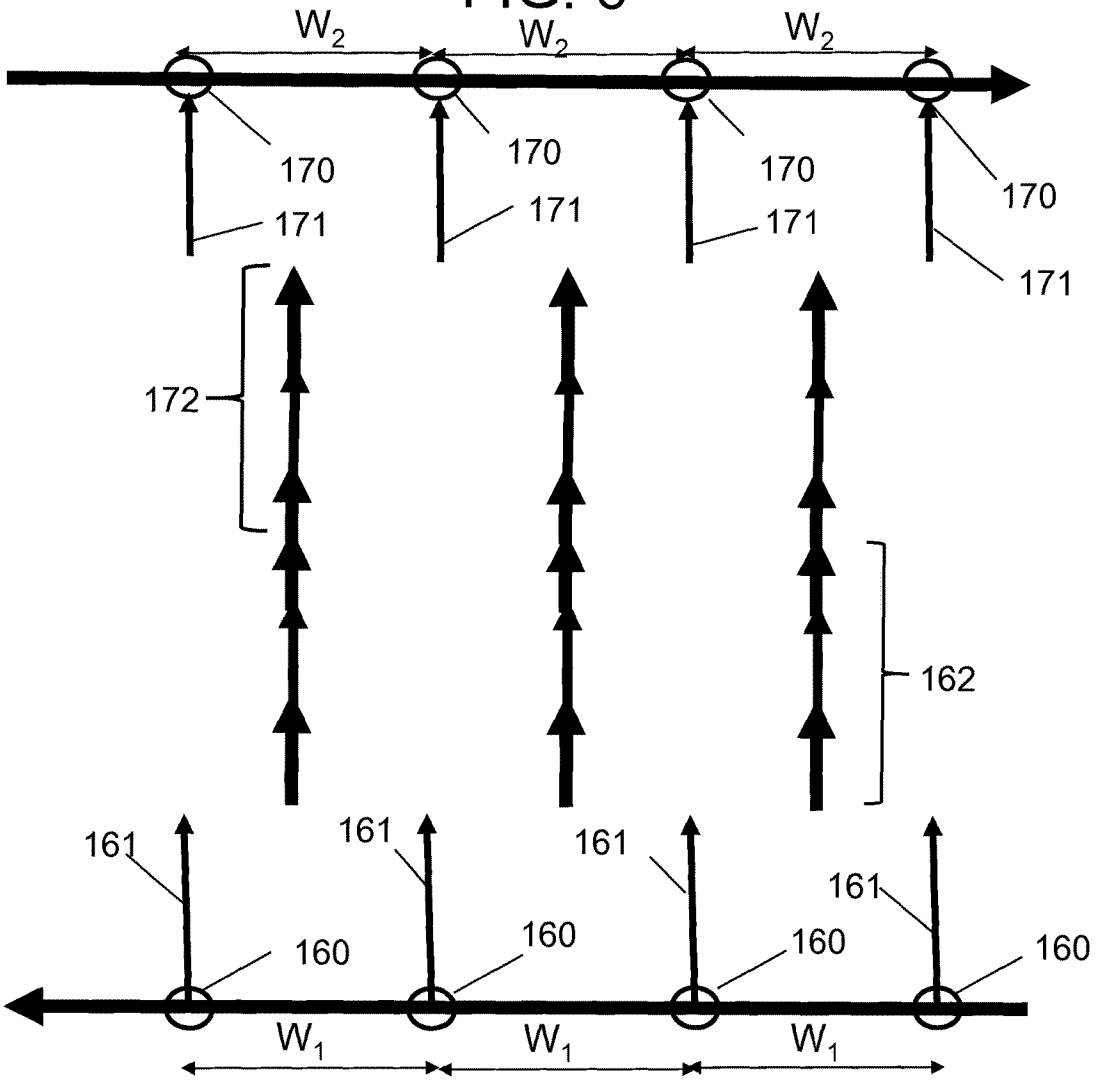
FIG. 6 shows two levels of constructive interference, the first level occurring one wavelength from the injection ports and the extraction ports and the second level occurring within the reservoir at a distance that depends on the phase timing control of the injection and extraction waves.

An example of a formation according to an embodiment of the invention is shown in FIG. 6. The formation includes multiple injection ports 160 and extraction ports 170. The extraction ports 170 can be production wells such as production well 110 shown and described in FIG. 3, and the injection ports 160 can be injection wells such as injection wells 120 and 130, also shown and described in FIG. 3

The injection ports 160 are each separated by a distance $W_1$. As an example, when the ports are separated by a distance of forty-two feet, waves having a frequency of twenty-seven hertz can be created. Pressure waves 161 are generated at the injection ports 160, each also having a wavelength that is the same distance $W_1$ as the distance $W_1$ between injection ports 160. By generating waves 161 with wavelengths $W_1$ corresponding to the distance $W_1$ between injection ports 160, the waves 161 constructively interfere and double in amplitude. In FIG. 6, four injection ports 160 are shown, but the number of injection ports 160 is not limited to four.

The extraction ports 170 are each separated by a distance $W_2$. Pressure waves 171 are generated at the extraction ports 170, each also having a wavelength that is the same distance $W_2$ as the distance $W_2$ between extraction ports 170. By generating waves 171 with wavelengths $W_2$ corresponding to the distance $W_2$ between extraction ports 170, the waves 171 constructively interfere and double in amplitude. The distance $W_1$ between injection ports 160 and the distance $W_2$ between extraction ports 170 can be the same distance, and correspondingly the pressure waves 161 and 171 can have the same wavelength. In FIG. 6, four extraction ports 170 are shown, but the number of extraction ports 170 is not limited to four.

A second level of constructive interference occurs when the waves 161 from the injection wells 161 meet the waves 171 of the extraction wells 170. This further constructive interference results in waves 162 and 172 that are further increased in amplitude. If the wavelengths $W_1$ and $W_2$ of the waves 161 and 171 are the same, the amplitudes will double. A control system 140, as shown and described in FIG. 3, is configured to manage the timing of the pulsing so that the waves 161 and 171 constructively meet. The control system 140 continuously takes measurements and adjusts to maximize the wave forces operating in the reservoir, as previously described. Maximizing the wave forces and the amplitudes of the waves maximizes the directional flow of the oil, gases and water in the reservoir from the injection well to the producer well.

The techniques for generating pressure pulsing waves in an oil or gas reservoir are not limited to those techniques previously described, but other techniques can be used without departing from the spirit of the invention.

FIG. 7 shows an embodiment of an enhanced oil recovery (EOR) apparatus or system, according to the present invention, for thermally conditioning an underground reservoir 301 in various ways to further facilitate the flow of oil and gas such as shown trapped in FIG. 2. Among other things, thermal conditioning reduces the viscosity of oil in reservoir 301, including oil 30 trapped in a pore 75 as shown in FIG. 2, which facilitates its flow. It should be understood that such conditioning can stand alone on the merits for facilitating oil and gas flow, or, as described herein, it may be a preparatory conditioning step before, after or during application of pressure waves to the reservoir 301 for the same purpose. The conditioning of a reservoir 301 as described herein further enhances the increased oil and gas recovery resulting from the application of pulsing pressure waves as previously described with reference to FIGS. 3-6.

FIG. 7 shows an embodiment where fluid heated in a boiler 321 is circulated in a closed loop above ground to and from a heat exchanger/mixer 314, and also below ground in a heat delivery well 302*b* in an underground oil/gas/brine reservoir 301. It should be realized that the heat delivery well 302*b* may be fed circulating hot fluid 312*b* by the boiler 321, by a separate boiler, or by another type of heat source. Wavy arrows 302 are shown emanating from the heat delivery well 302*b* in the reservoir 301 to signify the transfer of heat to the oil/gas/brine reservoir 301. Oil, gas, and brine produced from one or more production wells 303 is provided on a line 305*b* to at least one separator 306 that provides separated gas on a line 304 to the boiler 321, separated oil on a line 307 for storage, and separated brine on a line 308 to the heat exchanger/mixer 314. The separated gas is not flared, but rather, is put to use to increase hydrocarbon recovery flow rate. Hot exhaust 311 from the boiler 321 is provided to a mixer part of the heat exchanger/mixer 314 for mixing with the separated brine 308. The hot brine/exhaust mixture is injected into an injection well 317, where hot brine flooding takes place to heat the reservoir, displace the trapped hydrocarbons, and push or move the hydrocarbons toward the one or more production wells 303. Wavy arrows 320, 330 are shown emanating from the hot brine flooding well 317 into the reservoir 301 to signify the delivery of hot brine and $CO_2$ mixture to heat the oil/gas/brine reservoir 301 and to push and displace gas and oil toward the one or more production wells 303. Hot water from the boiler 321 is provided on a line 312 to the heat exchanger 314 where it transfers heat to the separated brine 308. The cooled fluid emerging from the heat exchanger 314 on a line 313*a* may be joined with cooled fluid 313*b* emerging from the heat delivery well 302*b* before the joined fluids 313*c* are together returned to the boiler 321 for re-heating. The re-heated fluid emerges from the boiler on line 312 for connection to the heat exchanger 314 and on line 312*b* for connection to the heat delivery well 302*b* in a repeating cycle of heating, cooling, and re-heating.

Also shown in FIG. 7, pressure waves 303*a* may be generated in both the one or more production wells 303 and additional pressure waves 317*a* in the at least one injection well 317. The pulsing pressure waves can be generated in the manner described above in reference to FIGS. 3-6. The underground placement of the production and injection wells with respect to each other may be advantageously configured such that constructive interference is facilitated and controlled with the production and injection waves controlled so as to be stimulating the reservoir simultaneously, continuously and synchronized in phase so as to meet in the reservoir and add constructively, thereby increasing the amplitude of the stimulating force imparted to the reservoir. The spatial relationship should be such that at least part of the production wave is propagated in a direction toward the injection well 317 and the injection wave is propagated in the opposite direction toward the production well 303 so that the waves meet in a space in between the wells and interfere constructively as shown in FIG. 1*d*.

Figure 8:
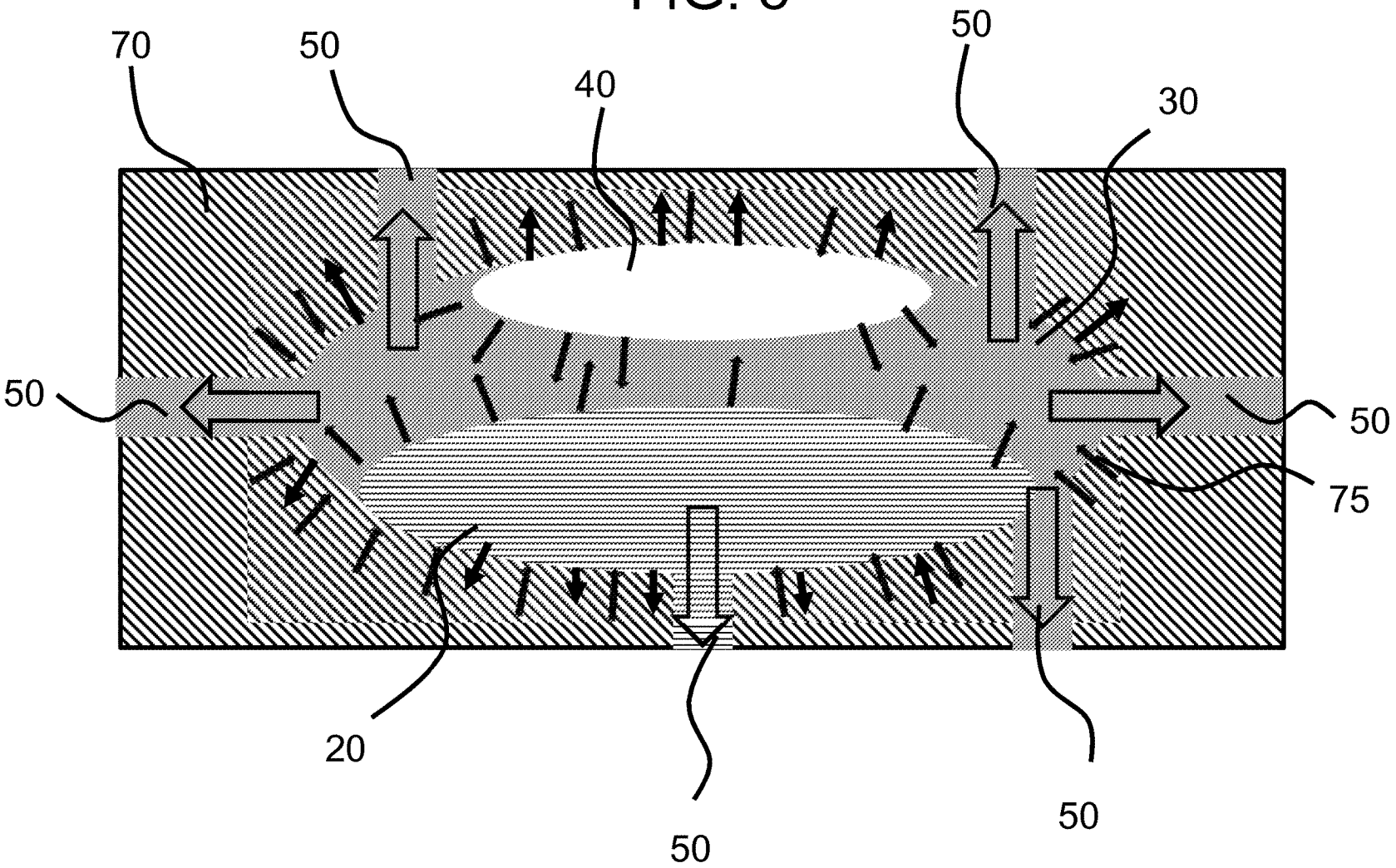
FIG. 8 shows the impact of applying thermal heating of a rock pore according to an embodiment of the invention.
Figure 9:
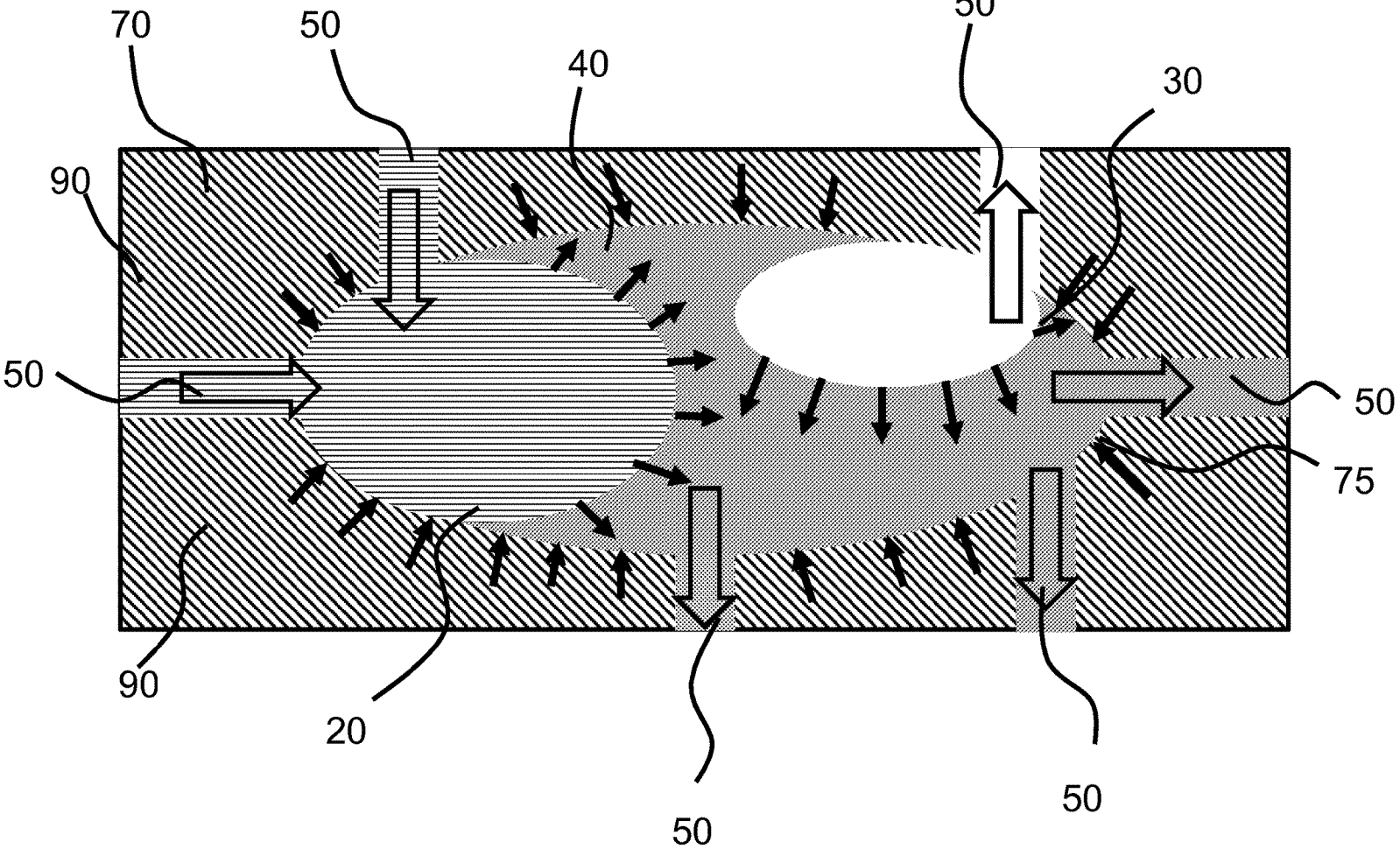
FIG. 9 shows the impact of hot brine and $CO_2$ and $N_2$ flooding of a rock pore from an injection well creating oil movement to producer wells according to an embodiment of the invention.

As shown in FIG. 8, the thermal conditioning described above causes expansion of all the substances in the rock pore 70, including any water 20, oil 30 and gas 40, so as to lower or break the surface tension 60, reduce capillary resistance and enhance flow through the capillaries 50. As shown in FIG. 9, the above described hot water or brine flooding 90 with $CO_2$ mixed in the hot water or brine may have an effect such as illustrated, with the flooding 90 of the reservoir 301 with the water and $CO_2$ mixture from the heat exchanger 314 pushing low viscosity oil 30 and gas 40 out of the rock pore 70.

Spatial relationships between conditioning, injection and production wells are depicted in two dimensions in FIG. 7 as well as in FIG. 3. They are shown as horizontal wells in parallel alignment in the plane of the drawing. These figures are each representative of a vertical cross-section underground the earth where the reservoir resides. It should be realized that the wells may be vertical wells or may include vertical wells. It should be further realized that the various types of wells need not necessarily be arranged in parallel alignment. Selected wells could be aligned obliquely or in perpendicular relation to each other. For instance, horizontal production wells may have a perpendicular relationship to horizontal injection wells. Therefore, it should be further realized that the spatial relationships between the wells may be in three dimensions. In that event, the interrelated spatial relationship of the wells then creates an underground three dimensional well structure within a corresponding three dimensional volume of the reservoir.

The systems shown in FIGS. 3, 6 and 7 can all incorporate a control system, such as control system 140 shown in FIG. 3 to monitor the performance of the three well types utilized in the well systems according to the invention, including: production wells (extracting the oil or oil/water/gas mixtures from the field), injection wells (delivering heated water or oil/water or water/$CO_2$ mixtures into the field), and thermal wells (delivering heat to the field via electric heating elements or internal circulation of hot water)

The production to injection well spacing can be set so that constructive interference of the pressure pulses created by the injection well (pushing) and the production well (pulling) can be easily synchronized. During operation, pressure amplitude and phasing data can be taken at a monitoring well, and at the injection and production wells, along with flow rates of injected and extracted fluids. Frequency and phasing of the pulsed pumping in the wells can be adjusted to create the constructive interference so that amplitude of the pulses can be maximized for the target extraction zone.

Another key to full reservoir harvesting is to adjust the location of the primary injection and extraction zones (the span of the series of evenly spaced access ports) along the well length as the resource matures, when a significant amount of oil has been extracted, and the region of higher temperature has expanded significantly into the resource. This is critical to directing the pulsed flow waves through newly heated regions in the resource so that the new oil reserves are accessed and swept toward the production well so that the oil to water ratio in the fluid entering the production well is maximized. Methods involving valves, concentric tubing, and acoustic manipulation can also be used. During operation, the control system can use information from the extracted flows such as flow rates and specifically oil to water ratio to determine when the pressure and flow access regions need to be adjusted. Unlike the pulse frequency and phasing control, which has a control loop cycle of seconds, the pulsed flow access region manipulation will only be adjusted in multiple month or year time periods.

A final key control aspect is the measurement of the heated zone radius around the heat delivery wells. The heated region around the heat delivery wells expands radially from the well bore over time. Knowing the position of the heated region where oil viscosity and surface tension are reduced is critical to determining the specific positioning of the well lengths where flow into and out of the resource needs to be restricted so that the flow path of lower flow resistance leads to harvested volumes of the reservoir. This radius can be measured at various locations on the monitoring well. The monitoring well and heat delivery wells do not run parallel so as to allow the temperature versus radial position from the heat delivery well.

The pressure amplitude of the pulsed pumping wave that is required to loosen oil held in tightly held formations can be determined in advance of operation. During operation, the control system can change the pulse amplitude in relatively small increments and then record the resulting extraction rate and composition of the oil. The energy used to extract the oil will be compared to the yield to maximize the efficiency of the process. This period for the modification of control parameters will be measured in days.

Perturbations of injected flow rate and temperature will also be imposed on the system and the oil extraction results assessed. A control algorithm can calculate the optimum injection rate and fluid temperature to optimize the net energy extracted.

The control system can also vary the amount of electric heat used in the heat delivery wells. Though the electrically imposed heat will produce higher heat saturation rates and temperatures, the resulting oil extraction rate must be balanced against the energy used to produce the electricity used for this purpose. Large amounts of hot fluid will be available for use in the heat delivery wells, so a control algorithm can specify the optimum process parameters to maximize the net energy yield form the formation. It should be noted that this process can be repeated periodically (likely in the monthly timeframe) to reassess the operation optimization, as these parameters will change significantly as the reservoir ages.

The control system can control the system using the following parameters as inputs, where available in the particular system: $CO_2$ flow rate and temperature in the injection well flowing into the formation, including a flow rate and temperature of the $CO_2$ exhaust from a boiler and a flow rate and temperature of the $CO_2$ exhaust optional gas/oil turbine generator; water flow rate in the injection well flowing into the formation composed of water (brine) return flow from the oil/gas/brine separator via the boiler and any additives or additional water used in the injection flow; temperature of the flow rate in the injection well; pressure wave amplitude, mean pressure, and frequency in the injection well; power to the injection well pump/oscillator; pressure wave amplitude, mean pressure, and temperature at the monitoring well at several locations; flow rate and temperature of the production well fluid composed of crude oil, water/brine/additives and gas to the boiler and/or turbine/generator; pressure wave amplitude, mean pressure, and frequency in the production well; power to the production well pump/oscillator; water flow rate to the boiler; temperature of the water flow rate to the boiler; temperature of the water flow rate from the boiler; flow rate of additional gas to the green boiler and/or turbine; separated gas flow rate to the green boiler; separated gas flow rate to the turbine/generator; electricity generated by the turbine/generator; temperature and flow rate to the heat exchanger mixer; temperature and flow rate to the heat delivery well; temperature leaving the heat delivery well; electric power to the heat delivery well; and electric power to the production well casing.

Outputs from the control system controlling the system equipment can include: injection well oscillating pump maximum pressure; injection and production well oscillating pump frequency; production well oscillating pump minimum pressure; water/additive injection flow rate; $CO_2$ injection flow rate; heated water injection flow rate; heated water flow rate to the heat exchanger/mixer; heated water flow rate to the heat delivery well; electric power to the delivery well heaters; electric power to the production well heaters; position of the pressure access port field in the injection well; position of the pressure access port field in the production well; additional gas fuel input to the boiler and/or turbine/generator; gas flow rate to the boiler; and gas flow rate to the turbine/generator.

The above listed inputs and outputs are not exhaustive. The specific parameters can be adjusted to the particular details of a given resource or system equipment configuration. The control system may comprise a non-transitory computer readable medium, such as a memory, and a processor configured to execute instructions for adjusting the components of the enhanced oil recovery system in response to feedback received from the monitoring well, pressure sensors and any other input receiving devices in the enhanced oil recovery system in communication with the control system.

While there have been shown and described and pointed out fundamental novel features of the invention as applied to preferred embodiments thereof, it will be understood that various omissions and substitutions and changes in the form and details of the devices and methods described may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice.

What is claimed:

1. A method, comprising:

conditioning an underground reservoir to cause oil and gas to increase flow, stimulating the conditioned underground reservoir with pressure waves to further increase flow, and recovering the oil and gas with increased flow;

wherein the stimulating is carried out with pressure waves generated from two or more locations in the underground reservoir so that pressure waves coming from a first location in the underground reservoir encounter pressure waves coming from at least a second location in the underground reservoir so as to combine through superposition in at least part of the underground reservoir.

2. The method of claim 1, wherein the pressure waves from the second location are in phase with the pressure waves from the first location in the at least part of the underground reservoir, creating a directed, pulse driven flow path for oil, water, and gas flow from the first to the second locations.

3. The method of claim 1, wherein the first location includes at least one injection well.

4. The method according to claim 3, wherein the injection well comprises a pump to inject a fluid into the underground reservoir and the pump pulses the fluid injections to create the pressure waves.

5. The method of claim 4, wherein the second location includes an oil production well.

6. The method of claim 5, wherein the oil production well comprises at least one pump configured to pump oil, and wherein the at least one pump is pulsed to create pressure waves.

7. The method of claim 5, wherein the pressure waves generated from the oil production well and the pressure waves generated from the at least one injection well are configured to constructively interfere.

8. The method according to claim 3, wherein the injection well comprises a plurality of pipes, including a first pipe and a second pipe, and wherein the method further comprises:

pressurizing hot liquid water to increase pressure;

injecting the hot, pressurized liquid water into the first pipe; and injecting colder liquid water into the second pipe in a pulsed manner;

wherein the reservoir has a pressure lower than the hot, pressurized liquid and the hot, pressurized liquid turns to lower pressure water vapor after injection, wherein the colder, liquid water mixes with the lower pressure water vapor, liquefying the water vapor; and wherein the changes in state and pressure of the hot, pressurized liquid creates pulsing pressure waves.

9. The method of claim 8, wherein at least a portion of each of the first pipe and the second pipe are provided within a single porous pipe.

10. The method of claim 1, wherein the conditioning comprises thermal conditioning of the underground reservoir.

11. The method of claim 10, wherein the thermal conditioning comprises heated brine/water flooding of the underground reservoir.

12. The method of claim 11, wherein the thermal conditioning further comprises combining $CO_2$ exhaust with heated brine/water used in the heated brine/water flooding, wherein the $CO_2$ is exhaust from a boiler fueled by the recovered gas to heat the brine/water recovered with the oil and gas before flooding the underground reservoir with the brine/water heated by the boiler.

13. The method of claim 10, wherein the thermal conditioning comprises:

circulating a heated fluid in a closed circulation system having part of the closed circulation system in the underground reservoir.

14. The method of claim 13, wherein the thermal conditioning further comprises:

pumping heated brine into a brine injection well in the underground reservoir using brine recovered along with the oil and gas from the underground reservoir, the recovered brine separated and heated in a heat exchanger by the heated fluid circulating in the closed circulation system, the heat exchanger fed by a boiler fueled by gas recovered from the underground reservoir, the recovered brine mixed with $CO_2$ exhausted from the boiler, and wherein the pressure waves are caused by a disturbance introduced into the heated brine that is pumped into the injection well.

15. The method of claim 1, further comprising:

circulating fluid both inside and outside the underground reservoir in a closed circulation system with a system part located at least in part in the underground reservoir and with a system part located at least in part outside the underground reservoir, and heating a cooled part of the fluid that is circulating in the system part located at least in part outside the underground reservoir after circulating out of the system part located at least in part in the underground reservoir so that the cooled part becomes a heated part of the circulating fluid, wherein the conditioning includes at least part of the heated part of the circulating fluid transferring heat to the underground reservoir when the at least part of the heated part of the circulating fluid is circulating in the system part located at least in part in the underground reservoir.

16. The method of claim 15, wherein the heating is carried out at least in part by a boiler and the boiler is fueled by gas extracted from the underground reservoir.

17. The method of claim 16, further comprising heating brine extracted from the underground reservoir by exchanging heat with at least another part of the heated part of the circulating fluid, mixing the brine extracted from the underground reservoir with $CO_2$ exhausted from the boiler, wherein the conditioning includes flooding the underground reservoir with the heated brine mixed with $CO_2$ exhausted from the boiler.

18. The method of claim 17, wherein the pressure waves are caused by a disturbance introduced into the heated brine mixed with $CO_2$ that is pumped into the injection well to flood the underground reservoir and synchronized with another disturbance applied to a mixture of brine, oil, and gas undergoing recovery in a part of an oil production well located at least in part in the underground reservoir so that pressure waves coming from the heated brine mixed with $CO_2$ add constructively in the underground reservoir with pressure waves coming from the mixture of brine, oil, and gas in the production well.

19. The method of claim 16, further comprising pulsing the underground reservoir with pressure waves propagated into the underground reservoir from pulsing the heated brine mixed with $CO_2$ during injection in synchronism with pressure waves propagated into the underground reservoir from pulsing the oil, gas, and brine in the underground reservoir, during extraction.

20. The method of claim 15, wherein at least part of the heating of the circulating fluid is carried out by heating the circulating fluid with heat from a geothermal well.

21. The method of claim 20, wherein part of the closed circulation system is in the geothermal well and wherein at least part of the heating of the circulating fluid is carried out by a boiler fueled by gas extracted from the underground reservoir.

22. The method of claim 21, further comprising heating brine extracted from the underground reservoir when the fluid in the closed circulation system circulates out of the system part located at least in part in the underground reservoir and when the fluid is circulating in the system part located at least in part outside the underground reservoir, mixing the brine extracted from the underground reservoir with $CO_2$ exhausted from the boiler, and wherein the conditioning includes flooding the underground reservoir with the heated brine mixed with $CO_2$ exhausted from the boiler.

23. An apparatus, comprising:

means for conditioning an underground reservoir to cause oil and gas to increase flow;

means for pulsing the conditioned underground reservoir with pressure waves to further increase flow; and means for recovering the oil and gas with increased flow wherein the means for pulsing generates pressure waves from two or more locations in the underground reservoir so that pressure waves coming from a first location in the underground reservoir encounter pressure waves coming from at least a second location in the underground reservoir so as to combine through superposition in at least part of the underground reservoir.

24. The apparatus of claim 23, wherein the means for conditioning comprises means for thermal flooding.

25. The apparatus of claim 24, wherein the means for conditioning comprises means for brine/water flooding.

26. The apparatus of claim 23, wherein the means for conditioning comprises means for $CO_2$ flooding.

27. The apparatus of claim 23, wherein the means for conditioning comprises:

means for thermal flooding with heated fluid circulating in a closed circulation system having part of the closed circulation system in the underground reservoir, and means for thermal flooding with heated brine/$CO_2$ pumped into a hot brine well in the underground reservoir using brine recovered along with the oil and gas from the underground reservoir, the recovered brine separated and heated in a heat exchanger by the heated fluid circulating in the closed circulation system, the heat exchanger fed by a boiler fueled by gas recovered from the underground reservoir, the recovered brine mixed with $CO_2$ exhausted from the boiler, and wherein the pulsing comprises:

means for pulsing the hot brine well and the heated brine/$CO_2$ therein with pressure waves at a controlled frequency and synchronized with pressure waves pulsing in a brine, oil, and gas mixture in a part of a production well in the underground reservoir.

* * * * *